United States Patent [19]

Fahmi

[11] 4,308,962

[45] Jan. 5, 1982

[54] SUPPORT ROD FOR MULTIPLE CLOTHES HANGERS

[76] Inventor: Ibrahim Fahmi, Lewrenz-Strasse 119, 4150 Krefeld, Fed. Rep. of Germany

[21] Appl. No.: 42,819

[22] Filed: May 29, 1979

[30] Foreign Application Priority Data

May 29, 1978 [DE] Fed. Rep. of Germany ... 7816030[U]

[51] Int. Cl.[3] ..... A47F 5/08

[52] U.S. Cl. ..... 211/118; 248/340

[58] Field of Search ..... 211/105.1, 123, 124, 211/118, 116, 113; 248/339, 340

[56] References Cited

U.S. PATENT DOCUMENTS

| | | | |
|---|---|---|---|
| 995,798 | 6/1911 | McCullough | 211/113 X |
| 1,966,283 | 7/1934 | Brody | 211/123 |
| 2,480,327 | 8/1949 | Idelsohn | 211/123 X |
| 2,604,999 | 7/1952 | Sutton | 211/123 X |
| 2,699,263 | 1/1955 | Ore | 211/113 |
| 2,714,965 | 8/1955 | Fitzkee et al. | 211/113 |
| 3,187,904 | 6/1965 | Kiechle | 211/123 X |
| 3,212,647 | 10/1965 | Meyer et al. | 211/118 |
| 3,456,807 | 7/1969 | D'Amato | 211/105.1 X |
| 3,782,559 | 1/1974 | Wright | 211/113 X |

FOREIGN PATENT DOCUMENTS

| | | | |
|---|---|---|---|
| 1303626 | 1/1973 | United Kingdom | 211/105.1 |

*Primary Examiner*—J. Franklin Foss

*Attorney, Agent, or Firm*—Toren, McGeady & Stanger

[57] ABSTRACT

A support rod for supporting a number of clothes hangers includes an elongated rigid bar having transverse openings therein for receiving the clothes hangers, and a pair of hooks pivotally mounted at the ends of the bar about axes which extend transversely of the bar. The bar can be suspended by one or both of the hooks. Also, the hooks can be swung toward each other in the long direction of the bar and manually grasped so that the bar can be held by one hand while a user places hangers through the bar openings with the other hand.

1 Claim, 2 Drawing Figures

SUPPORT ROD FOR MULTIPLE CLOTHES HANGERS

Figure 1:
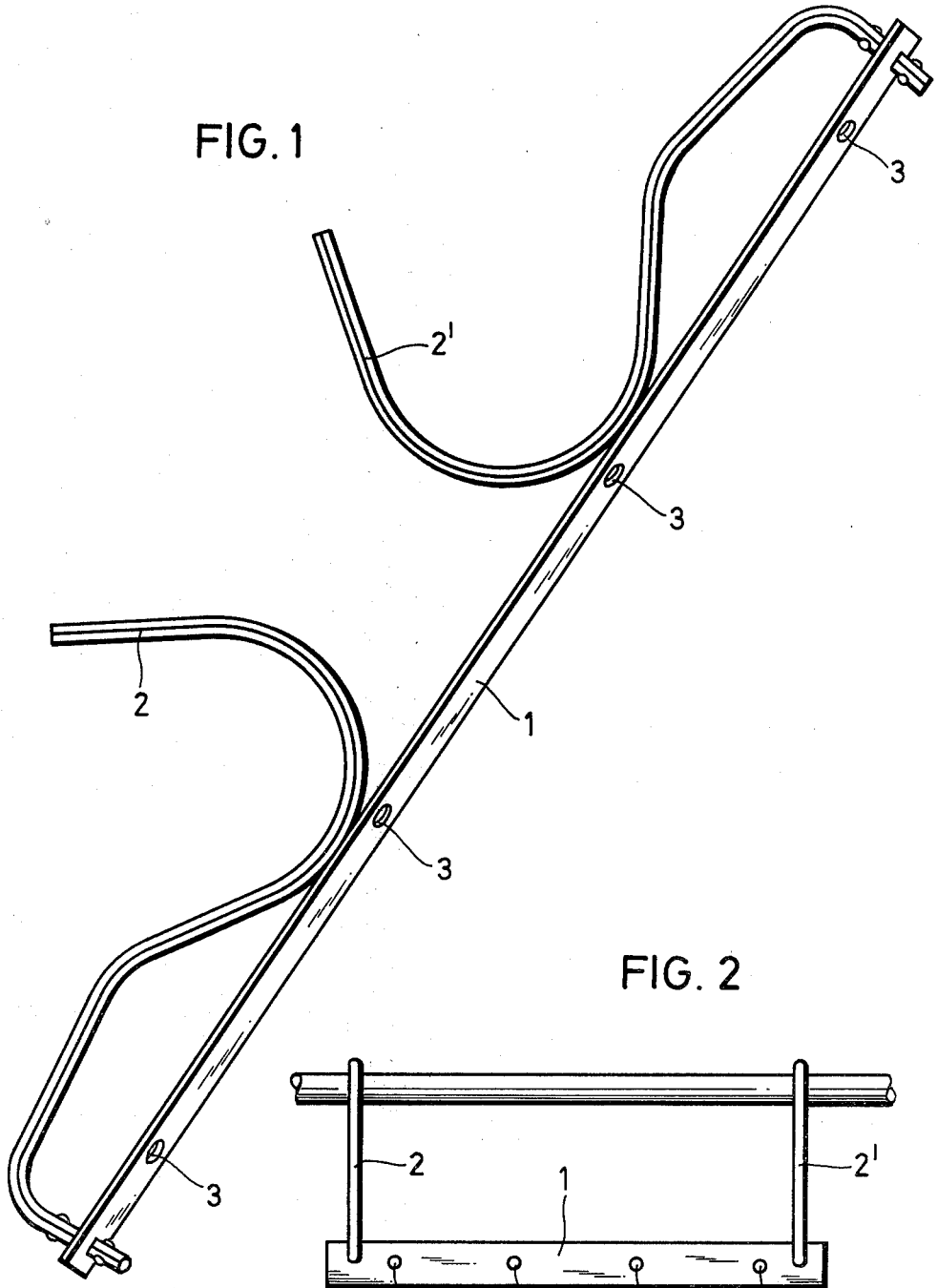

The invention relates to a support rod of so-called multiple clothes hangers which is intended for hanging a plurality—usually three or four—hangers in a staggered manner next to each other and one above the other on the clothes bar of a closet or of closet shelves, on the hook of a clothes stand, a clothes rack or the like.

A known support rod of this type made in one piece consists of a straight piece of stiff wire which is bent at its upper end to form a hook and onto which there are fastened a plurality of clothes hangers arranged essentially parallel relative to each other and to the plane of the upper hook and with their centers spaced one on top of the other.

The clothes hangers fastened to a support rod in such a manner pose significant difficulties concerning the storage and the removal of articles of clothing because, for this purpose, only a narrow, gap-like space is available between always two hangers and not only the other hangers but especially also the articles of clothing arranged thereon represent a significant hindrance to the manipulation of a hanger. It is also very difficult to achieve the desired unwrinkled fit of articles of clothing which are to be stored for longer periods of time and it is essentially impossible to check this fit. These difficulties are only slightly smaller in the case of removing and hanging up articles of clothing on hangers which are fastened to the support rod so as to be swingable to a limited extent.

It is the object of the invention to provide a support rod for multiple clothes hangers which, as a result of its design, makes the clothes hangers fastened to the support rod easily accessible without negatively influencing the space-saving storage of articles of clothing which can be achieved with multiple clothes hangers.

In accordance with the invention, this is achieved in a support rod for clothes hangers which are arranged thereon in a staggered manner next to each other and one above the other thereby that the support rod consists of a bending-resistant bar which is provided with a plurality of bores each serving for detachably suspending a clothes hanger and that on each end of this bar there is fastened a hook which can be swung about an axis which extends perpendicular relative to the plane of the bar.

The two freely swingable hooks make it possible to horizontally suspend the support bar on the bar of a closet, of shelves or a clothes rack, wherein these bores of the bar and the hangers inserted therein are arranged with those equal spacings next to each other which they assume one on top of the other when the bar is arranged vertically. As a result, the individual hangers and the articles of clothing suspended therefrom are freely accessible. Moreover, the detachable fastening of the clothes hangers makes it possible to arrange articles of clothing on the hangers separately from the bar and completely unhindered or to remove articles of clothing from the hangers. Consesquently, when the articles of clothing are once again arranged on the horizontally extending bar, there is no danger that the articles of clothing are shifted from their given positions on this hanger or an adjacent hanger.

After one of the hooks has been lifted off from its support, the hangers once again reach their space-saving, staggered position.

Due to the fact that the length of the hooks is dimensioned in such a way that the support bar can be held by a human hand at the hooks which are swung toward each other, it is possible to manipulate the multiple hanger without the utilization of special means for hanging up the bar.

Figure 2:
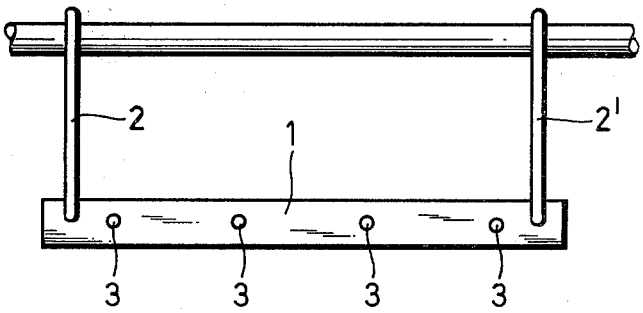

An embodiment of the support rod forming the subject matter of the invention is illustrated in the drawing. In the drawing:

FIG. 1 shows a view of the support rod lying on a surface approximately in its natural size, FIG. 2 schematically shows the same support rod in a smaller scale with both of its hooks hanging on a support bar.

The support rod consists of a bending-resistant metal rod 1 having four bores 3 each serving to hang up a clothes hanger, and with the two hooks 2, 2', each of these hooks being freely swingably fastened on one of the ends of the bar 1.

What is claimed is:

1. A support rod for supporting a plurality of clothes hangers comprising an elongated rigid bar having a pair of opposed planar surfaces with a plurality of first bores spaced apart in the elongated direction of said bar and extending between and through said planar surfaces, each said first bore arranged to receive a single hanger so that the hanger can be removably suspended from said bar, said rigid bar having a second bore at each of the opposite ends thereof spaced apart in the elongated direction with said second bores extending between and through said planar surfaces, a hook-shaped single unit member fitted into and secured within each of said second bores with the end of said hook-shaped member within said second bore extending perpendicularly to said planar surfaces, each said hook-shaped member being freely rotatable through 360° within the corresponding said second bore about the axis of the end of said hook-shaped member extending through said second bore and said hooks are constructed dimensioned and arranged to be held by a human hand for suspending said bar when said hooks are moved toward each other and extend in the long direction of said bar.

* * * * *